United States Patent [19]

Wickoren

[11] Patent Number: 4,981,366

[45] Date of Patent: Jan. 1, 1991

[54] METHOD AND APPARATUS FOR MIXING LIQUID CONTENTS IN A VESSEL

[75] Inventor: Dean R. Wickoren, Paola, Kans.

[73] Assignee: Suburbia Systems, Inc., Olathe, Kans.

[21] Appl. No.: 316,072

[22] Filed: Feb. 27, 1989

[51] Int. Cl.[5] ..... B01F 5/12

[52] U.S. Cl. ..... 366/262; 210/197

[58] Field of Search ..... 366/150, 165, 262, 263, 366/136, 137, 163, 167; 210/197, 194, 259, 260

[56] References Cited

U.S. PATENT DOCUMENTS

| | | | |
|---|---|---|---|
| 2,024,986 | 12/1935 | Durdin, Jr. . | |
| 2,048,640 | 7/1936 | Sperry . | |
| 2,067,161 | 1/1937 | Durdin, Jr. . | |
| 2,076,529 | 4/1937 | Durdin, Jr. . | |
| 2,337,507 | 12/1943 | Thayer . | |
| 2,359,004 | 9/1944 | Schlenz et al. . | |
| 2,481,959 | 9/1949 | Wahlin | 366/136 |
| 2,597,802 | 5/1952 | Kappe . | |
| 2,678,915 | 5/1954 | Kalinske . | |
| 2,786,025 | 3/1957 | Lamb et al. . | |
| 2,788,127 | 4/1957 | Davidson . | |
| 2,875,151 | 2/1959 | Davidson . | |
| 3,092,678 | 6/1963 | Braun . | |
| 3,152,982 | 10/1964 | Pagnotti . | |
| 3,194,756 | 7/1965 | Walker . | |
| 3,452,966 | 7/1969 | Smolski . | |
| 3,470,092 | 9/1969 | Bernard . | |
| 3,682,313 | 8/1972 | Abraham et al. . | |
| 3,724,667 | 4/1973 | McKinney . | |
| 3,827,679 | 8/1974 | Kaelin . | |
| 3,865,721 | 2/1975 | Kaelin . | |
| 3,910,838 | 10/1975 | Kaelin . | |
| 3,951,806 | 4/1976 | Young . | |
| 3,953,326 | 4/1976 | Reimann . | |
| 4,021,021 | 5/1977 | Hall | 366/165 |
| 4,039,439 | 8/1977 | Clark . | |
| 4,045,336 | 8/1977 | Isteri . | |
| 4,076,515 | 2/1978 | Rickard . | |
| 4,111,808 | 9/1978 | Fair . | |
| 4,188,289 | 2/1980 | Besik . | |
| 4,192,740 | 3/1980 | Savard et al. . | |
| 4,242,199 | 12/1980 | Kelley . | |
| 4,246,111 | 1/1981 | Savard et al. . | |
| 4,272,369 | 6/1981 | Love . | |
| 4,290,885 | 9/1981 | Kwak . | |
| 4,303,517 | 12/1981 | Love et al. . | |
| 4,330,407 | 5/1982 | Shermer et al. . | |
| 4,376,045 | 3/1983 | Siskind . | |
| 4,388,186 | 6/1983 | Fujimoto et al. . | |
| 4,392,955 | 7/1983 | Soriente . | |
| 4,394,268 | 7/1983 | Reid . | |
| 4,586,825 | 5/1986 | Hayatdavoudi | 366/165 |
| 4,613,434 | 9/1986 | Määttä . | |
| 4,746,433 | 5/1988 | Nöbl et al. . | |
| 4,793,929 | 12/1988 | Kickuth et al. . | |

*Primary Examiner*—Robert W. Jenkins

*Attorney, Agent, or Firm*—Hovey, Williams, Timmons & Collins

[57] ABSTRACT

Apparatus for the mixing of liquids within a vessel which utilizes at least one pump in fluidic communication with the liquid in the vessel to create a streamflow of the liquid into a draft tube disposed within the vessel. Pumps are positioned with respect to the draft tube to direct primary streamflows of liquid through the wall of the draft tube to thereby induce an additional flow of liquid through the inlet of the draft tube. The primary streamflows intersect within the draft tube intermediate the ends thereof and both the primary and streamflows pass to an outlet and of the draft induced tube thereby to create continuous circulation of the liquid within the vessel when the pumps are actuated. In alternative embodiments, the pumps may be offset to produce a helical streamflow within the draft tube. The draft tube also may be divided into two or more sections whereby additional inlets or outlets may be provided intermediate the ends of the tube. A method of mixing the fluid within the vessel is provided wherein the mixing apparatus, including an upright draft tube, may be placed within the vessel and the pumps actuated to generate both the primary and induced flow of liquid into and through the draft tube to circulate and mix the liquid contents of the vessel.

26 Claims, 4 Drawing Sheets

METHOD AND APPARATUS FOR MIXING LIQUID CONTENTS IN A VESSEL

BACKGROUND OF THE INVENTION

1. Field of the Invention

This invention relates to a method and apparatus for mixing liquid within a vessel employing a mixing system utilizing both pump-generated flow and induced flow to thoroughly mix the contents of the vessel. More particularly, it is concerned with a method and apparatus for mixing liquid material having suspended particulates which have a tendency to settle and collect on the bottom of the container or vessel such as a sewage digester, whereby the liquids may be continuously mixed to produce an enhanced distribution of the various layers and settleable particulates throughout the contents of the vessel. This mixing is accomplished by the use of at least one pump oriented to direct the flow generated thereby into a draft tube having a larger diameter than the outlet diameter of the pump in order to produce an induced flow of liquid through the draft tube.

2. Description of the Prior Art

It has heretofore been well known to mix liquids of varying specific gravities or having suspended solids therethrough in an attempt to achieve thorough and uniform distribution of the liquids throughout the vessel. Mixing may be important in a variety of contexts, including chemical refining, food manufacturing, and waste water treatment. In some of these industries, liquids may contain suspended particulate matter which must constantly flow to avoid creation of a stratified condition of various components of the mixture, or to avoid settlement of the particulate matter.

In larger containing vessels, the tendency of certain particulate materials to settle may produce a compacted layer along the bottom of the vessel. For example, in sewage treatment and waste water processing, suspended particulate matter may be sequentially transferred to a series of vessels until reaching a final containment vessel. The liquid transferred into this final vessel may contain a high proportion of suspended solids which, if not continuously agitated, will settle to produce a hardened layer at the bottom of the vessel which is resistant to fluid transfer and may be removed only be dredging, digging or the like. Similarly, in petroleum tanks holding crude oil, heavy components such as asphalt and tar may tend to settle prematurely unless agitated and continuously mixed.

In sewage treatment systems, such as anaerobic digesters, it is especially important to achieve thorough mixing of the contents of the vessel in order to achieve not only a uniform distribution of the digestible materials within the liquids, but also to strive for near uniform temperature distribution within the vessel. It has been found that anaerobic digestion is most effective when the temperature of the liquid is within a few degrees of about 95 degrees Fahrenheit, and thus the most efficient digestion of the liquid is achieved when the temperature is nearly constant throughout the vessel in this range.

Another problem encountered in such digestors is the accumulation of a layer of scum at the surface of the vessel. Such scum resists mixing and builds up in a gradually thickening layer until the efficiency of the digestion process within the vessel is reduced.

Thus, it is important to alleviate the accumulation of scum and thoroughly integrate the liquid components of the vessel into a nearly homogenous mixture. It has been found that by continuously mixing the scum which accumulates at the top of the vessel into the remaining liquids, the complete digestion of the liquid will be quickly and efficiently accomplished. In ordinary digestion processes, the liquid contents of the vessel tend to segregate into layers of a froth or scum at the top, a liquid layer in an intermediate region, and a layer of sediment or sludge at the bottom. Yet further, in anaerobic digestion, methane gas is generated as a useful by-product of the anaerobic digestion process, which accumulates above the layer of froth or scum and is trapped beneath a cover on the vessel. Ordinarily, the methane will be evacuated for use as a fuel, sometimes known as "biogas", while the sediment or sludge is pumped or drained from the bottom of the tank for use agriculturally as a fertilizer or otherwise disposed of. The liquid may be drawn off for further treatment and processing, while the scum layer must be dealt with as a waste by-product of the sewage treatment. However, when the material within the tank has been thoroughly and completely, digested, such scum layer is often kept to a minimum and presents few difficulties in disposal.

A number of various processes for achieving a thorough distribution of sediment or sludge have heretofore been known. The problems of thorough mixing having been previously encountered and others have attempted to achieve mixing of the liquids within a vessel through a draft tube generally oriented at the center of the vessel. In one approach, a pump, agitator or propellor is located within the draft tube in order to circulate the liquid therethrough, as illustrated for instance by U.S. Pat. Nos. 2,024,986, 2,048,640, 2,067,161, 2,076,529, 2,337,507, 2,359,004, 2,597,802, 2,678,915, 2,788,127, 2,875,151, 3,194,756, 3,470,092, 3,827,679, 4,045,336, 4,188,289, 4,192,740, 4,246,111, 4,290,885, 4,330,407, 4,388,186, 4,394,268, 4,613,434, and 4,746,433.

In another approach, movement of the liquid through the draft tube has been achieved by gas lift, whereby a source of compressed gas is allowed to expand and rise through the draft tube, carrying with it a quantity of liquid, as shown for example in U.S. Pat. Nos. 3,152,982, 3,682,313, 3,910,838, 4,039,439 and 4,793,929.

Yet further, some have sought to achieve thorough intermixing by a combination of these approaches, as shown in U.S. Pat. Nos. 2,786,025, 3,092,678, 3,724,667, 3,953,326, 4,076,515, and 4,242,199.

However, such approaches have not generally utilized a combination of primary flow and induced flow of the accumulated liquid to achieve maximum efficiency of the mixing process, but also have failed to successfully address the problem of the extremely thick and difficult to pump materials which may accumulate in a final settling vessel or digester which must be continuously agitated to avoid solidification. Finally, the problems presented by the build up of froth or scum at the upper layer of the liquid should preferably also be addressed by a simple, easy to construct and maintain apparatus.

SUMMARY OF THE INVENTION

The problems outlined above are in large measure solved by the method and apparatus for mixing liquid contents of a vessel in accordance with the present invention. That is to say, the mixing apparatus hereof accomplishes thorough and directed flow of the liquids within the container or vessel by generation of induced flow of the liquids through a centrally disposed draft tube.

The mixing apparatus includes at least one fluid pump provided with an outlet oriented to provide a directed stream of pump flow into and through a draft tube provided with openings upstream and downstream from the outlet of the pump. As a result, the flow through the outlet of the pump generates an induced flow of fluids through the draft tube, causing an increased total flow of pumped liquids through the draft tube. The streamflow of the liquids may thus be oriented to provide the desired distribution flow pattern throughout the mixing vessel.

Preferably, the apparatus hereof includes two or more pumps generating a primary flow through the outlets thereof. The streamflow from the pumps is oriented to interact and provide an additive effect for producing increased induced flow through the inlet end of the draft tube. The pump streamflows may either intersect or be offset to produce a swirling flow within the draft tube., The draft tubes are preferably oriented within the tank to place the inlet end of the draft tube and the inlet end of the pump in association with the desired strata to be mixed, such as a sedimentary layer, and positioned to achieve substantially uniform mixing of the liquids throughout the vessel.

The position of the pumps may be at any location along the tube, and may, for example, be oriented to direct the flow of liquid either horizontally, upwardly or downwardly through the draft tube. Yet further, in another embodiment, the draft tube may be provided with two sets of pumps oriented in substantially opposite directions with respect to a horizontal plane and energize at alternative intervals to achieve thorough intermixing of all the liquids within the container.

In yet further embodiments, the draft tube may be altered to present a frustoconical configuration opening in a downstream direction from the flow of the pumps to diminish the effects of hydraulic forces on the pumped material. Yet further, the draft tube may be segmented and provided with openings therealong to cause mixing at intermediate locations along the draft tube. Finally, the draft tube may be provided with angularly disposed vanes to induce swirling of the flow entering or exiting the draft tube. The vanes may serve in cooperation with the offset orientations of the fluid pumps to enhance the circumferential or swirling movement of the fluids within the vessel.

DESCRIPTION OF THE PREFERRED EMBODIMENT

Figure 1:
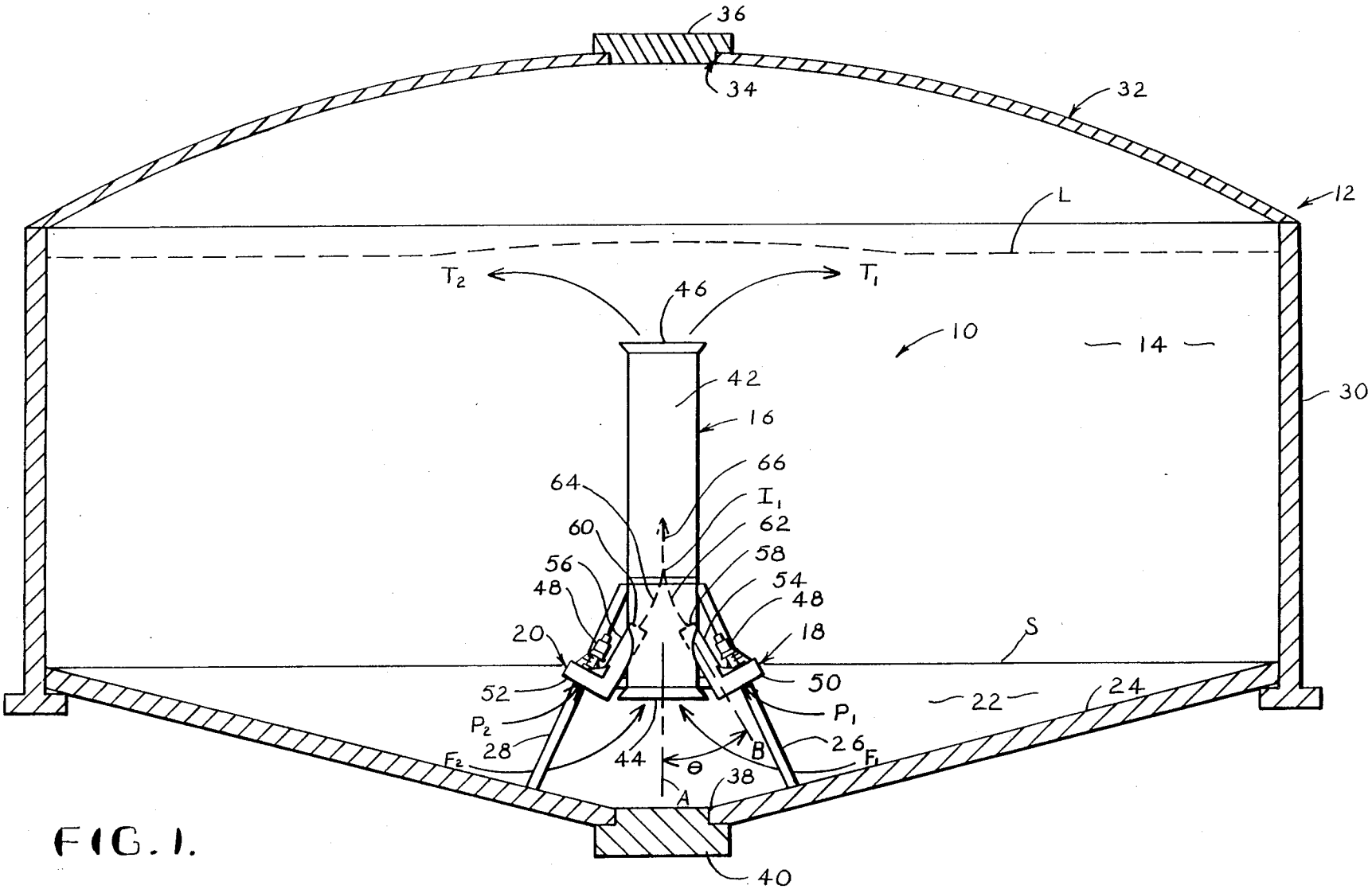
FIG. 1 is a vertical partially sectional view through a vessel showing a first embodiment of the mixing apparatus disposed within the vessel in accordance with the present invention.

Referring now to FIG. 1, a mixing apparatus 10 in accordance with the present invention is positioned within a vessel 12 and preferably oriented at the geometric center thereof in order to insure thorough mixing cf the liquid 14 therein. The mixing apparatus 10 broadly includes draft tube 16 and at least one streamflow generating means such as a first pump 18. In the preferred embodiment, the mixing apparatus 10 is provided with two or more pumps as indicated by second pump 20. Pumps 18 and 20 are preferably radial flow pumps equipped with a trash handling impeller to cut strings, rags, or the like which may have accumulated in the sediment layer 22 of the liquid 14. The draft tube 16 is preferably suspended somewhat above the bottom wall 24 of the vessel and in fluid communication with the sediment layer 22, and is supported above the bottom wall 24 by support members 26 and 28.

In greater detail, vessel 12 is provided with a side 30 which is preferably smooth and uninterrupted around the vessel 12 to present no pockets or corners for the accumulation of sediment and to insure a smooth flow of the liquid 14 throughout the vessel 12 during mixing. Thus, side 30 is preferably circular in configuration. The vessel 12 may be provided with a cover 32 for certain applications such as anaerobic digestion of sewage. The cover 32 defines an opening 34 at the center thereof which is of sufficient diameter to receive draft tube 16 therethrough. During operation, the opening is sealed by cap 36 to prevent the escape of odors or methane generated during the digestion process. Such cover 32 may also include a vent (not shown), for removal of methane generated during the digesting process.

The bottom wall 24 of the vessel 12 is preferably angled downwardly, as shown in FIG. 1, to permit removal of sludge or sediment 22 from a drain 38 through and defined by the bottom wall 24. Such drain 38 may be provided with a seal 40 or, alternatively, with a drain pipe (not shown) for removal of the sediment 22 upon the completion of the digesting process.

Turning now to the mixing apparatus 10 itself, the draft tube 16 is provided with a wall 42 and presents a generally cylindrical configuration having an open inlet 44 at one end thereof and an opposed, open outlet 46. The draft tube 16 is preferably oriented along a generally vertical axis A, which axis A is also preferably the geometric center of the vessel 12 with respect to the side 30.

Pumps 18 and 20 are mounted to extend through side wall 42 of the draft tube 16, and are preferably of the same size and capacity. Each pump 18, 20 is powered by a motor 48, the motor being electrically, or preferably hydraulically powered. As shown in FIG. 1, pumps 18 and 20 are provided with suction ends 50 and 52 respectively, through which the liquid 14 may enter the pumps 18 and 20. Elongated discharge tubes 54, 56 are oriented along an axis B at an angle theta from axis A. The angle theta may be between 0 and 89 degrees, but more preferably it is in the range of 5 to 45 degrees. Discharge tubes 54 and 56 are each provided with a discharge end 58, 60 through which streamflows defined by paths 62 and 64 are directed to a point of conversion $I_1$.

As shown in FIG. 1, the pumps 18 and 20 are positioned with their discharge tubes 54 and 56 extending in a generally upward direction, causing streamflow paths 62 and 64 to be directed in an upward direction. The orientation of the pumps 18 and 20 and thus the streamflow paths 62 and 64 generated thereby, produce an upwardly directed primary flow path 66. In operation, the streamflow paths 62 and 64 which combine to produce upwardly directed flow path 66 have a generally additive effect, and produce an induced flow of liquid 14 from inlet 44 to outlet 46. Thus, the total flow of liquids through the draft tube 42 include not only the primary flow 66 produced as a combination of streamflow path 62 and streamflow path 64, but also the induced flow received into draft tube 16 from inlet 44. It has beer found that such induced flow may comprise $\frac{7}{8}$ or more of the total flow exiting outlet 46 of draft tube 16.

As the total flow exits outlet 46, which is preferably below level L defining the upper level of liquids within the vessel 12, it will distributed generally throughout the tank, and in this manner generate a circulating path of liquids in a generally donut or toroidal path, as shown by the streamflow arrows exiting outlet 46 and the inlet arrow shown adjacent inlet 44 and suction ends 50 and 52. Circulation of the liquid 14 will continue in this manner to achieve thorough mixing of the contents of the vessel 12 until uniform mixing has been achieved, or thereafter to insure maximum distribution of the particulate matter tending to concentrate in sediment layer 22 below sediment level S throughout the vessel 12.

It may be appreciated that it is most desirable that inlet 44 extend below level S into sediment 22, and also that suction ends 50 and 52 lie below level S to remain in fluidic engagement with sediment layer 22 so that the heavier materials comprising sediment 22 may continuously be agitated and the entire contents of the vessel 12 may be thoroughly mixed.

When the mixing apparatus 10 hereof is used as an anaerobic digester, the continuous mixing process alleviates the accumulation of a layer of scum on top of level L, which otherwise would not only diminish the efficiency of the mixing process but also rob the digester of its usable volume and result in the loss of methane generating capacity.

When the liquid 14 has been digested, a portion of the sediment layer 22 is pumped or drained off through drain 38, and a portion of the remaining supernatant is drawn off for reprocessing. The volume of sediment and supernatant drawn off is replaced with waste water and/or sewage, and further digestion occurs.

It may be appreciated that the digestion process generates methane gas which is trapped beneath cover 32 above level L, and prior to removing cover 32 or opening cap 36, it is necessary to vent or flare off methane gas trapped therein. It is thus especially undesirable to cease operation of the mixing apparatus 10 except under the most extreme circumstances. By having two or more pumps 18 and 20, digestion and mixing of the liquid 14 within the vessel 12 will continue even should one of the pumps 18 or 20 cease operation due to mechanical failure, jamming by trash within the sediment, or the like. In any event, should removal of the pumps 18 and 20 be necessary, opening 34 is of a sufficient diameter to enable removal of all or part of the apparatus without removal of the entire cover 32.

Figure 2:
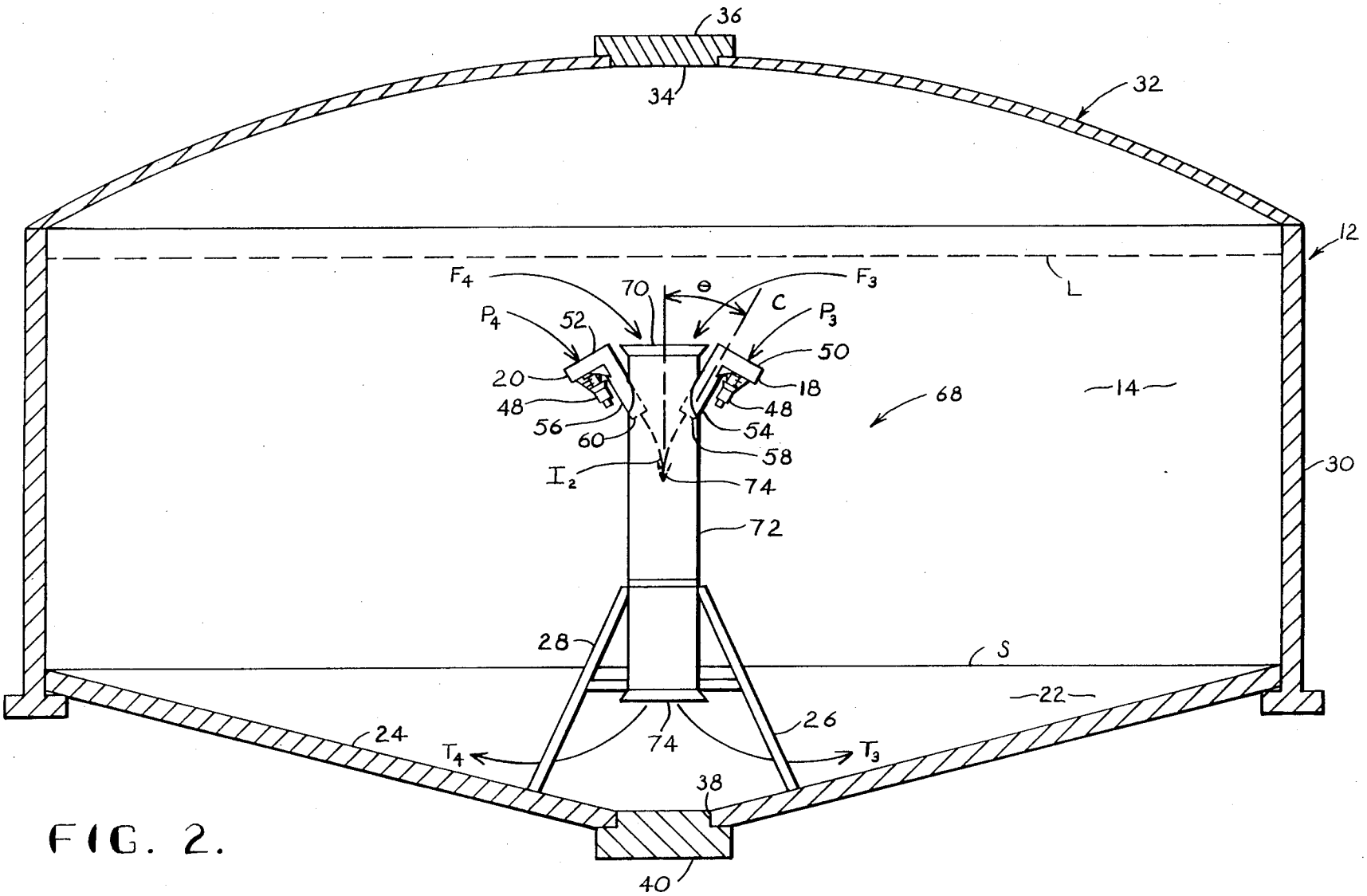
FIG. 2 is a vertical partially sectional view through a vessel showing an alternate embodiment of the mixing apparatus disposed within the vessel in accordance with the present invention.

A mixing apparatus 68 as shown in FIG. 2 is similar to the mixing apparatus 10 as shown in FIG. 1 except that the mixing apparatus 68 is configured so that liquid 14 is drawn through an inlet 70 located at the top of draft tube 72, with outlet 74 being at the lower or bottom end of the draft tube 72. In the embodiment shown in FIG. 2, like numerals are used to indicate components which are the same as in FIG. 1.

In the embodiment shown in FIG. 2, pumps 18 and 20 are provided with elongated discharge tubes 54 and 56 as in FIG. 1, with discharge openings 58 and 60 which are also the same as the pumps in FIG. 1. However, the pumps are oriented at a downward angle, with the discharge tubes being aligned axis C. Axis C is at an angle theta relative to the axis of cylindrical tube 72, whereby the streamflow generated by pumps 18 and 20 as shown in FIG. 2 intersect at a point $I_2$ below inlet 70 of draft tube 72. Angle theta is between 0 and 89 degrees, and more preferably is between 5 degrees and 45 degrees.

In this manner, suction ends 50 and 52 of pumps 18 and 20 in FIG. 2 are oriented upwardly. This is especially advantageous in insuring thorough mixing of liquid 14 when a blanket of scum extends above liquid layer L. The scum is drawn downwardly along with liquid 14 into both suction ends 50 and 52 to create a primary flow along path 74. Additional liquid 14 and scum above layer L is drawn downwardly through inlet 70, the flow through inlet 70 being induced by the streamflows generated by pumps 18 and 20. Thus, total flow includes primary flow 74 and the induced flow through inlet 70, indicated schematically by arrows F3 and F4, with the total flow being schematically indicated leaving outlet 74 by arrows T3 and T4. It may thus be appreciated that flows T3 and T4 represent a total flow through outlet 74, and comprise the sum of primary flows P3 and P4 through suction ends 50 and 52 respectively, and induced flows F3 and F4 through inlet 70 of tube 72. Again, as indicated by arrows F3, F4, P3, P4 and T3, T4 the flow throughout the vessel 12 is substantially toroidal or donut shaped.

Figure 3:
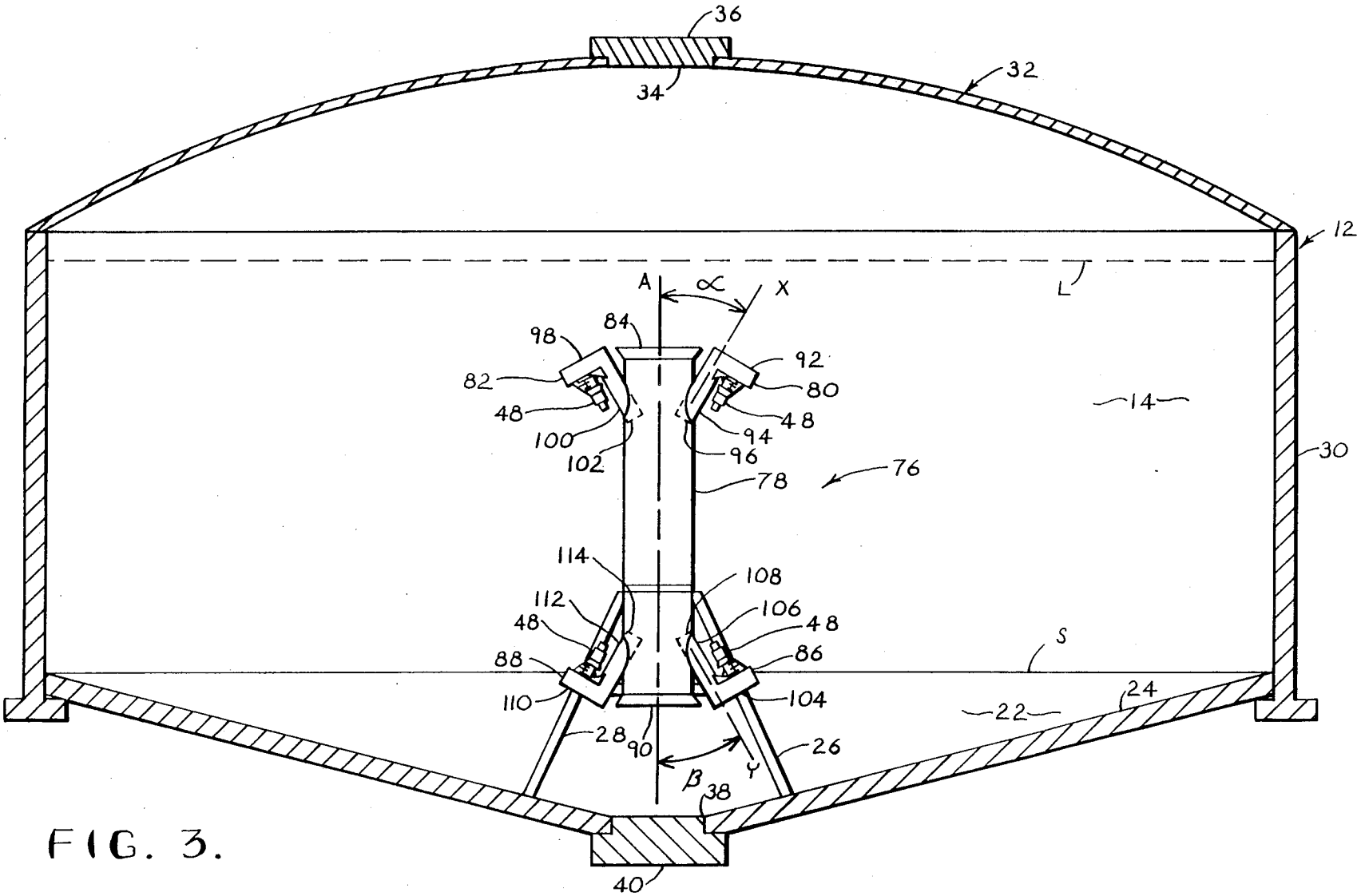
FIG. 3 is a vertical partially sectional view through a vessel showing an alternate embodiment of the mixing apparatus disposed within the vessel in accordance with the present invention.

Turning now to FIG. 3, an alternate embodiment of the mixing apparatus shown in FIGS. 1 and 2 is represented by the numeral 76, with like numbers corresponding with like components in FIGS. 1 and 2. In the mixing apparatus shown in FIG. 3, a total of two or more pumps are employed in opposing directions. Thus, as shown in FIG. 3, mixing apparatus 76 includes a draft tube 78 shown with downwardly directed pumps 80 and 82 mounted adjacent upper end 84 of draft tube 78, while upwardly directed pumps 86 and 88 are located adjacent bottom end 90 of draft tube 78. Pumps 80, 82, 86 and 88 may be radial flow pumps having a trash-cutting impeller just as pumps 18 and 20 described hereinabove, although pumps with a pass through impeller would preferably be used to reduce power consumption. Pump 80 is provided with a suction end 92, discharge tube 94 and a discharge end 96, with pump 82 similarly being provided with a suction end 98 a discharge tube 100 and a discharge end 102.

Discharge tubes 94 and 100 are oriented along an axis X at an angle alpha to axis A through the center line of cylindrical draft tube 78. Angle alpha is between 0 and 89 degrees, and preferably in the range of 5 to 45 degrees thus, as shown in FIG. 3, pumps 80 and 82 are oriented to generate a streamflow through outlets 96 and 102 in a generally downward path, the streamflows generated by pumps 80 and 82 generally converging along axis A.

On the other hand, pump 86 similarly provided with a suction end 104, a discharge tube 106 and a discharge end 108, while pump 88 is also provided with a suction end 110, a discharge tube 112, and a discharge end 114.

Pumps 86 and 88 are oriented with their discharge tubes 106, 112 respectively, aligned along an axis Y at an angle beta to axis A through the center line of cylindrical draft tube 78. Thus, the streamflows generated by pumps 86 and 88 intersect along axis A at a point within draft tube 78 and above pumps 86 and 88. Angle beta is between 0 and 89 degrees, and preferably between 5 and 45 degrees.

In operation, mixing apparatus 76 permits the liquid 14 within vessel 12 to be alternately circulated upwardly or downwardly through draft tube 78 by selectively and alternately activating either pumps 80 and 82 or pumps 86 and 88. In this manner, should the sediment layer 22 become too thick, pumps 86 and 88 may be energized to provide additional primary flow to circulate and drive the sediment 22 upwardly through the draft tube 78, while if the layer of scum above level L becomes too great, pumps 86 and 88 may be de-energized and pumps 80 and 82 may be energized to circulate liquid 14 downwardly. The pumps may thus be cyclically energized in order to create chaotic action within the vessel, which tends to reduce clogging of the pumps and draft tube with stringy material and rags found within the sewage liquid 14.

Again, as in FIGS. 1 and 2, liquids circulating through pumps 80 and 82, or alternately 86 and 88, constitute the primary flow, which also generates an induced flow of liquid through the draft tube 78. For example, when pumps 80 and 82 are energized, top end 84 becomes the inlet of the draft tube 78, with bottom end 90 becoming the outlet. Alternatively, when pumps 80 and 82 are deenergized and pumps 86 and 88 are energized, lower end 90 becomes the inlet of draft tube 78, with upper end 84 becoming the discharge of draft tube 78.

Figure 4:
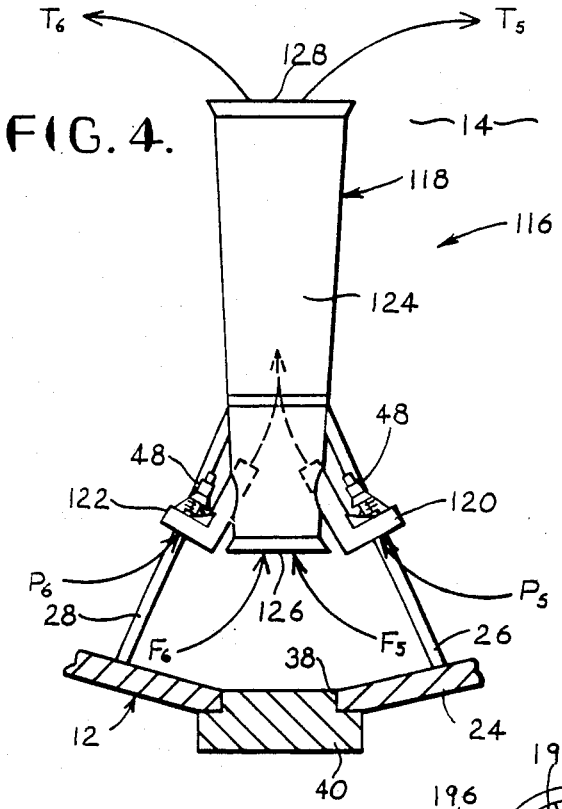
FIG. 4 is a fragmentary sectional view through a vessel similar to the view of FIG. 1, showing an alternate embodiment of the mixing apparatus wherein the draft tube is provided with an increasing diameter progressively from the inlet to the outlet thereof.

In the mixing apparatus 116 shown in FIG. 4, the flow is shown substantially as it appears in FIG. 1, with the exception that draft tube 118 is essentially frustoconical in configuration; that is to say, pumps 120 and 122 are similar in all respects to pumps 80 and 82, with like numerals being used to indicate other like components of the pumps in vessel 12. However, wall 124 of draft tube 118 is frustoconical to present a narrower inlet 126 than outlet 128. Thus, primary flow P5 flowing through pump 120 and primary flow P6 flowing through pump 122 combined with induced flow F5 and F6 flowing through inlet 126 to generate total flow T5 and T6 which is greater than the combined flows P5 and P6. The benefit of the frustoconical configuration of the draft tube 118 is especially noticed in mixing vessels 12 of great height, wherein draft tube 118 need be of an especially elongated configuration.

Thus, in such applications, the hydraulic head within the vessel 12 will tend to reduce the flow in a standard, cylindrical draft tube necessitating additional horsepower be supplied by motor 48. However, such effects may be largely ameliorated by reducing the velocity of the flow through the draft tube by increasing the cross-sectional area of the draft tube 118 in an upward or downstream direction as shown in FIG. 4. Because the area is increased, the velocity of the flow is somewhat reduced, reducing the pressure in the draft tube 118 and thus ameliorating the effects of a hydraulic head of the fluid 14.

Figure 5:
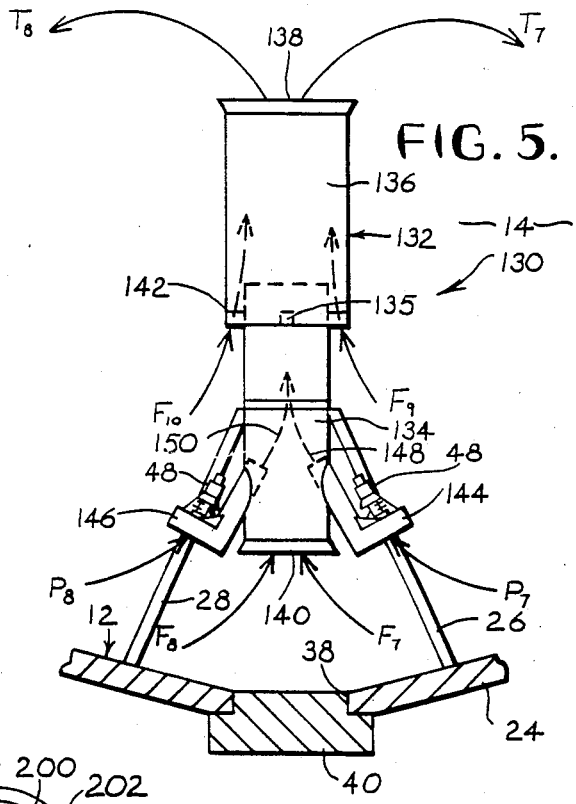
FIG. 5 is a fragmentary sectional view through a vessel similar to the view of FIG. 1, showing an alternate embodiment of the mixing apparatus wherein the draft tube is segmented to provide a downstream section of increased diameter for inducing flow into the tube from a location intermediate the inlet and the outlet thereof.

Turning now to FIG. 5, a yet further embodiment of the invention is shown as mixing apparatus 130 wherein the configuration of the draft tube 132 is again altered to provide further mixing characteristics. In the embodiment of the draft tube 132 shown in FIG. 5, the draft tube 132 is segmented into a first, substantially cylindrical smaller diameter section 134, and a second section 136 of increased diameter relative to first section 134. The first and second sections are suitably joined by brackets 135 or the like.

Thus, as shown in FIG. 5, draft tube 132 presents a single outlet 138 but also a first, generally circular inlet 140 and a second, generally annular inlet 142 intermediate first inlet 140 and outlet 138. The mixing apparatus also includes pumps 144 and 146 which are the same as the pumps 18, 20, 80, 82, 86, 88, 120 and 122 previously shown in FIGS. 1 through 4. Flow generated by the pumps 144 and 146 is indicated by streamflows 148 and 150 which converge within draft tube 132 as shown.

The particular advantage of the draft tube 132 as shown in FIG. 5 is the provision of an additional inlet 142 intermediate first inlet 140 and outlet 138. In the embodiment shown in FIG. 5, total output through outlet 138 is shown schematically as T7 and T8 which is greater than the sum of the streamflows 148 and 150 which are also shown as primary flows P7 and P8. The induced flow includes F7 and F8 through first inlet 140 as well as induced flow F9 and F10 through anular inlet 142 and continues toroidally as shown in FIG. 1.

Figure 6:
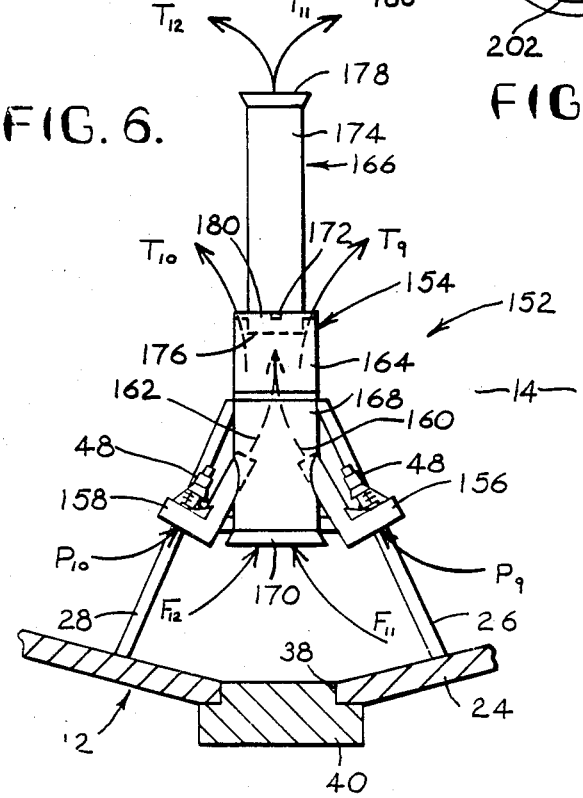
FIG. 6 is a fragmentary sectional view through a vessel similar to that shown in FIG. 1, showing an alternate embodiment of the mixing apparatus wherein the draft tube is segmented to provide a downstream section of smaller diameter than the upstream section, thereby enabling a portion of the induced flow to escape the draft tube at a location intermediate the inlet and outlet ends thereof.

Now referring to the embodiment shown in FIG. 6, mixing apparatus 152 is substantially similar to the mixing apparati previously shown in FIGS. 1, 4 and 5, with the exception of the configuration of the draft tube 154, pumps 156 and 158 generate streamflows 160, 162 which correspond in volume to primary flows P9 and P10 entering pumps 156 and 158 respectively. Pumps 156 and 158 are powered by motor 48 and are the same as the pumps shown in FIGS. 1–5.

Draft tube 154 is comprised of first and second sections 164 and 166. First section 164 is provided with pumps 156 and 158 attached thereto. First section 164 is of a generally larger diameter than second section 166. First section 164 is defined by a generally cylindrical wall 168 defining inlet 170 and opposed margin 172. A plurality of brackets adjacent margin 172 connect first section 164 to second section 166.

Second section 166 is generally defined by substantially cylindrical wall 174 extending between a lower margin 176 and circular outlet 178. Lower margin 176 lies within first section 164, with the area between first section 164 and second section 166 defining a generally annular outlet 180.

Thus, when pumps 156 and 158 are energized, the flow into draft tube 154 includes primary flows P9 and P10, as well as induced flows F11 and F12 the total of primary flows P9 and P10 and induced flows F11 and F12 equal the total output which is distributed between annular outlet 180 and circular outlet 178 respectively, shown schematically as T9 and T10 for annular outlet 180 and T11 and T12 for circular outlet 178. The embodiment shown in FIG. 6 is especially useful for generating intermediate outlet flows for improved circulation within the vessel 12, and produces a somewhat modified torroidal distribution flow through the vessel 12.

Figure 8:
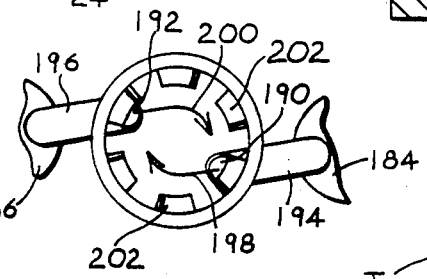
FIG. 8 is an enlarged, fragmentary top plan view of the alternate embodiment of the apparatus as shown in FIG. 7, illustrating the tangentially offset stream flows from the outlets of the fluid pumps and the angulation of the vanes adjacent the outlet of the draft tube.
Figure 7:
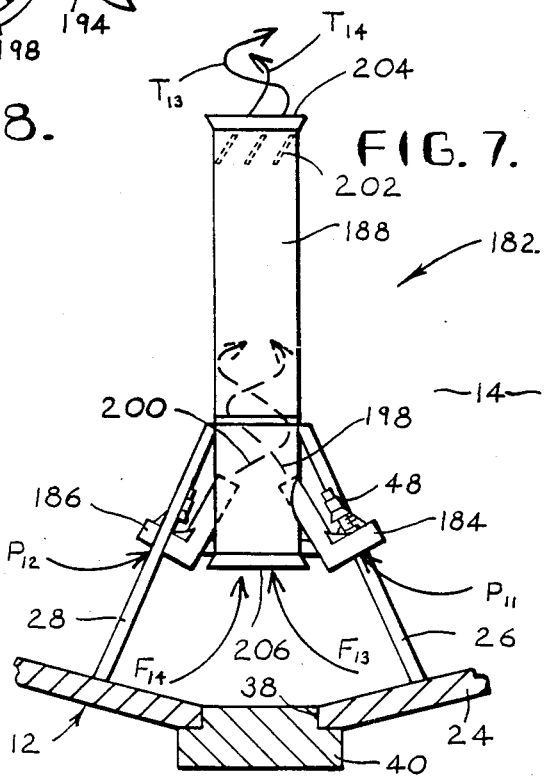
FIG. 7 is a fragmentary sectional view through a vessel similar to that shown in FIG. 1, showing an alternate embodiment of the mixing apparatus, showing the fluid pumps tangentially offset to create a rotational flow within the draft tube, and showing a plurality of vanes disposed adjacent the outlet end of the tube.

In the embodiment shown in FIG. 7, the mixing apparatus 182 is substantially similar to the apparatus shown in FIG. 1, with the exception that the pumps 184 and 186 (which are the same as pumps 18 and 20 shown in FIG. 1) are offset to produce streamflows having helical paths inside draft tube 188 as shown in FIG. 8. The pumps 184 and 186 are provided with discharge ends 190 and 192 and discharge tubes 194 and 196 respectively. Thus oriented, the streamflows 198, 200 thereby produced are tangentially offset to produce a helical flow path within the draft tube 188.

This helical effect may be enhanced by the provision of parallel angled vanes 202 interior of the draft tube 188, the draft tube 188 being in other respects similar to draft tube 16 as shown in FIG. 1. Thus, the effect of the helical flow path within the tube is to create a circumferential movement of the fluid within the tank, as not only the total flow T13, T14 emerging from outlet 204 of draft tube 188 is provided with a rotational component, but also primary flows P11 and P12 and induced flows F13 and F14. Thus, the flows are oriented rotationally as well as axially through the draft tube 182. A somewhat slow moving vortex is thereby created causing swirling of the liquid 14 within the tank by the movement of the flows F13 and F14 through inlet 206, the flows P11 and P12 entering pumps 184 and 186, and the total outlet flows T13 and T14 emerging from outlet 204.

As has been previously mentioned, pumps 18, 20, 80, 82, 86, 88, 120, 122, 144, 146, 156, 158, 184, and 186 are preferably hydraulicly powered. In this manner, each of the pumps may be driven at variable power inputs or R.P.M.'s in order to accommodate the different viscosities or loads of the liquid 14 within the vessel 12. Yet further, each of the mixing apparati of the present invention may be employed in hazardous or flammable material by the use of hydraulic motors 48 which generally avoid the creation of any spark sufficient to ignite flammable liquid, as when liquid 14 is petroleum. In other non-flammable environments, the use of hydraulic motors in submerged pumps eliminates the electrical problems normally encountered with submerged electric motors, and are reversible to dislodge trash or large materials jammed within the pumps.

If it is desired to heat the material being circulated and mixed within the vessel, the draft tube may be fitted with a suitable heat exchanger jacket whereby to impart heat to the liquid as it moves through the tube, with the heated liquid then passing throughout the vessel, as described herein, to distribute heat to the entire contents of the vessel.

As shown herein, the mixing apparatus is generally indicated in a vertical position. However, the mixing apparatus hereof may be horizontally positioned or employed at any angle in order to provide radial or circumferential movement of the liquids 14 within the vessel 12. In such circumstances, it may be beneficial to provide a plurality of mixing apparati in a single vessel 12 in order to achieve the desired, uniform flow distribution.

Having herefore set forth the preferred embodiment of my invention, it may be appreciated that many minor modifications can be made to this structure described herein above without departing from the teachings described herein above.

I claim:

1. An apparatus for mixing the liquid contents of a vessel comprising:

an elongated draft tube having a wall, an inlet and an outlet, said inlet being oriented for fluidic communication with said liquid contents of said vessel;

first and second fluidic pumps for generating a streamflow of liquid, each of said pumps presenting a suction end located exterior to said draft tube and in fluidic communication with said liquid contents and a discharge tube for directing said generated streamflow through said draft tube wall intermediate said inlet and outlet, said discharge tube presenting a discharge end, said discharge end of said first pump and said discharge end of said second pump being oriented for direction opposing streamflows interiorly of said draft tube and directed generally downstream toward said outlet for inducing a flow of liquid through said draft tube, said streamflow from said first pump and said streamflow from said second pump intersecting within said draft tube.

2. An apparatus for mixing the liquid contents of a vessel comprising:

an elongated draft tube having a wall, an inlet and an outlet, said inlet being oriented for fluidic communication with said liquid contents of said vessel;

first and second fluidic pumps for generating a streamflow of liquid, each of said pumps presenting a suction end located exterior to said draft tube and in fluidic communication with said liquid contents and a discharge tube for directing said generated streamflow through said draft tube wall intermediate said inlet and said outlet, each of said discharge tubes presenting a discharge end, said discharge end of said first pump and said discharge end of said second pump each being oriented for directing a streamflow interior to said draft tube and in a generally downstream direction toward said outlet for inducing a flow of liquid through said draft tube, said first pump and said second pump each being positioned adjacent the inlet end of said draft tube.

3. A mixing apparatus as set forth in claim 2, said pumps each being positioned adjacent the inlet end of said draft tube, said inlet end being the normally lowermost end of said draft tube.

4. A mixing apparatus as set forth in claim 2, said pumps each being positioned adjacent the inlet end of said draft tube, said inlet end being the normally uppermost end of said draft tube.

5. A mixing apparatus as set forth in claim 4, there being a pair of said pumps adjacent the inlet end and the outlet end of said draft tube.

6. A mixing apparatus as set forth in claim 5, said discharge tubes of each of said pairs of pumps being directed toward a point intermediate the inlet and outlet ends of said draft tube, each of said pairs being selectively actuatable.

7. An apparatus for mixing the liquid contents of a vessel comprising:

an elongated draft tube having a wall, an inlet and an outlet, said inlet being oriented for fluidic communication with said liquid contents of said vessel; and at least one means for generating a streamflow of liquid, said means having a suction and being located exterior to said draft tube and oriented for fluidic communication with said liquid contents of said vessel, said discharge and being located for directing said generated streamflow interiorly of said draft tube intermediate said inlet and said outlet and oriented to direct said generated streamflow generally toward said outlet for inducing a flow of liquid through said draft tube, said draft tube having multiple sections of different diameters, there being an opening between each of said sections.

8. An apparatus for mixing the liquid contents of a vessel comprising:

an elongated draft tube having a wall, an inlet and an outlet;

means mounting said draft tube within said vessel for placing said inlet in communication with the liquid contents of the vessel;

means for generating an induced flow of liquid from said inlet through said outlet of said tube, said flow inducing means including a pump assembly having a suction end and a discharge end; and means mounting said discharge end for directing a streamflow through said wall intermediate said inlet and said outlet in a direction generally toward said outlet and mounting said suction end in communication with said liquid contents, and for locating said suction end more proximate said inlet than said discharge end to augment the flow of said liquid contents into said inlet.

9. A mixing apparatus as set forth in claim 8, wherein said discharge tube from said first pump and said second pump are axially offset for generating a streamflow along a helical path toward said outlet.

10. A mixing apparatus as set forth in claim 8, wherein said draft tube is vertically oriented.

11. A mixing apparatus as set forth in claim 10, wherein said vessel is an anaerobic sewage digester tank.

12. A mixing apparatus as set forth in claim 8, wherein said liquid contents are sewage.

13. A mixing apparatus as set forth in claim 8, wherein said liquid contents are petroleum.

14. A mixing apparatus as set forth in claim 8, said draft tube being frustoconical in configuration and increasing in diameter from its inlet end to its outlet end.

15. A mixing apparatus as set forth in claim 8, there being a plurality of vanes interiorly of said draft tube and positioned for inducing circumferential flow of liquid through said draft tube.

16. An apparatus for mixing the liquid contents of a vessel comprising:

an elongated draft tube having a wall, an inlet and an outlet, said inlet being oriented for fluidic communication with said liquid contents of said vessel;

at least one streamflow-generating fluidic pump, said pump including a suction end and a discharge end; and means mounting said pump on said draft tube with said pump contained within said vessel and oriented for submersion in said liquid contents.

17. A mixing apparatus as set forth in claim 16, wherein said discharge tube from said first pump and said discharge tube from said second pump are axially offset for generating a streamflow along a helical path toward said outlet.

18. A mixing apparatus as set forth in claim 16, wherein said draft tube is vertically oriented.

19. A mixing apparatus as set forth in claim 18, wherein said vessel is an anaerobic sewage digester tank.

20. A mixing apparatus as set forth in claim 19, wherein said liquid contents are sewage.

21. A mixing apparatus as set forth in claim 16, wherein said liquid contents are petroleum.

22. A mixing apparatus as set forth in claim 16, said draft tube being frustoconical in configuration and increasing in diameter from its inlet to its outlet.

23. A mixing apparatus as set forth in claim 16, there being a plurality of vanes interiorly of said draft tube and positioned for inducing circumferential flow of liquid through said draft tube.

24. A method of anaerobically digesting liquid sewage within a vessel comprising:

positioning an upright draft tube within said vessel, said draft tube presenting an inlet and an outlet;

mounting at least one fluidic pump assembly adjacent said inlet, and submersed in said liquid contents, said pump assembly including a suction end and a discharge end, said discharge end being oriented to direct a primary streamflow through said discharge end intermediate said inlet and said outlet;

generating a primary streamflow of said liquid sewage through said pump assembly into said draft tube;

generating an induced streamflow of said liquid sewage into said inlet; and discharging both said primary streamflow and said induced streamflow from said outlet to thereby circulate the liquid contents of said vessel.

25. A method of anaerobically digesting liquid sewage as set forth in claim 24 including orienting said pump assembly with said suction end immersed in said liquid contents and more proximate said inlet than said discharge end.

26. A method of anaerobically digesting liquid sewage as set forth in claim 25, including the steps of generating a first primary streamflow from a first pump assembly and a second primary streamflow from a second pump assembly and converging said first and second primary streamflows in intersecting relationship within said tube.

* * * * *